US005214801A

United States Patent [19]

Christensen et al.

[11] Patent Number: 5,214,801

[45] Date of Patent: Jun. 1, 1993

[54] HEAD BRIM FOR USE DURING HAIR DRYING

[76] Inventors: Willow M. Christensen, 8928 N. 17th La., Phoenix, Ariz. 85021; Harry DaCosta, 5925 Foothill Dr. North; George L. Golna, 7101 Quartz Mountain Rd., both of Paradise Valley, Ariz. 85253

[21] Appl. No.: 890,766

[22] Filed: Jun. 1, 1992

[51] Int. Cl.[5] ..... A45D 20/00

[52] U.S. Cl. ..... 2/174; 2/184.5; 2/191; 132/212

[58] Field of Search ..... 2/171, 177, 191, 184.5, 2/9, 12, 174, 206, 410, 417, 418, 172, 184.5, 7, DIG. 11; 132/212, 213, 214, 270

[56] References Cited

U.S. PATENT DOCUMENTS

| | | | |
|---|---|---|---|
| 270,660 | 1/1883 | Gros et al. | 2/177 |
| 540,524 | 6/1895 | Wardwell | 2/191 |
| 919,984 | 4/1909 | Powell et al. | 2/187 |
| 1,232,277 | 7/1917 | Glaser | 2/187 |
| 2,226,956 | 12/1940 | Womack | 2/174 |
| 2,323,515 | 7/1943 | Cary et al. | 2/174 |
| 2,743,455 | 5/1956 | Langress | 2/191 |
| 3,557,386 | 1/1971 | Fisher | 2/191 |

FOREIGN PATENT DOCUMENTS

| | | | |
|---|---|---|---|
| 213612 | 7/1882 | France | 2/191 |
| 1826 | of 1862 | United Kingdom | 2/191 |

*Primary Examiner*—Clifford D. Crowder
*Assistant Examiner*—Amy Brooke Vanatta

[57] ABSTRACT

A brim that can be placed around the head of a user whereby air directed from the top of the user's head is deflected from the user's face. The brim comprises a plurality of links forming a chain with each link being pivotally connected to adjacent links and which can be adjusted and fastened about the head of the user. Each of the links has top and bottom coplanar surfaces, an outer edge having a first arc of a first predetermined radius, an inner edge having a second arc of a second predetermined radius with a center portion of the inner edge being formed perpendicular to the top surface of the link wherein the surface will extend outwardly from the user's head thereby deflecting the air away from the user's face. The center inner edge portions are pivotally attached to one another by a flexible connector so that the user can encircle the links about the user's head. A fastener holds the brim together while in use.

7 Claims, 1 Drawing Sheet

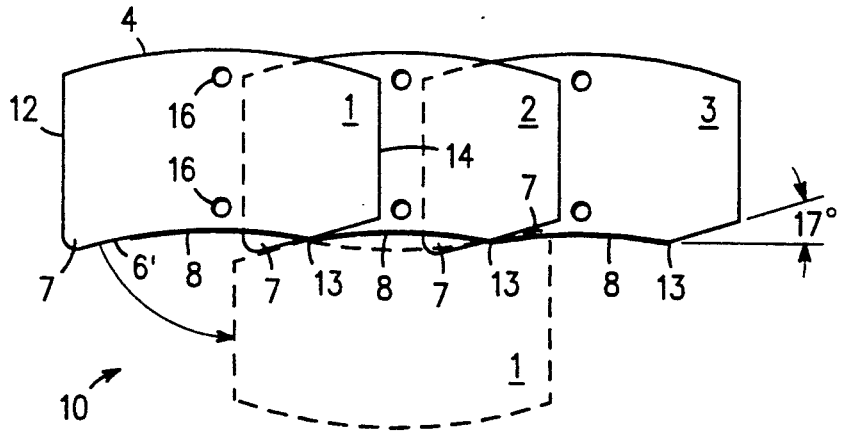
FIG.1
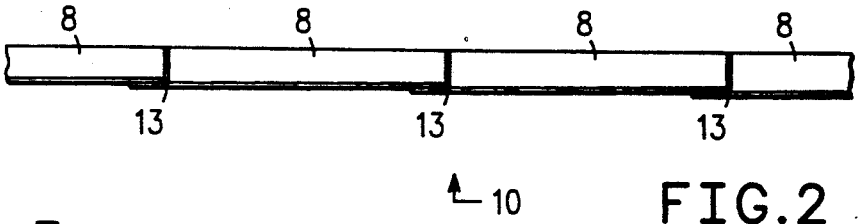
FIG.2
FIG.3
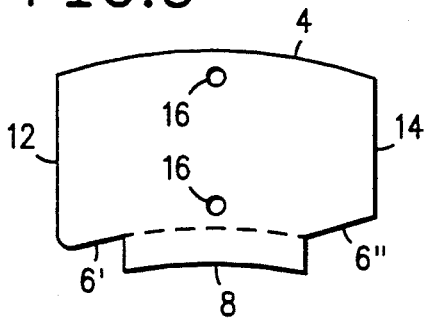
FIG.4
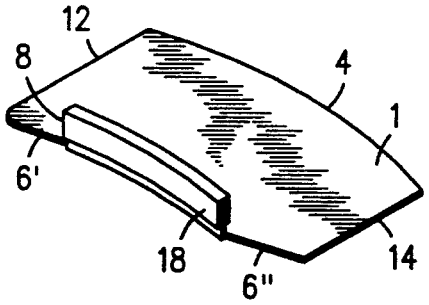
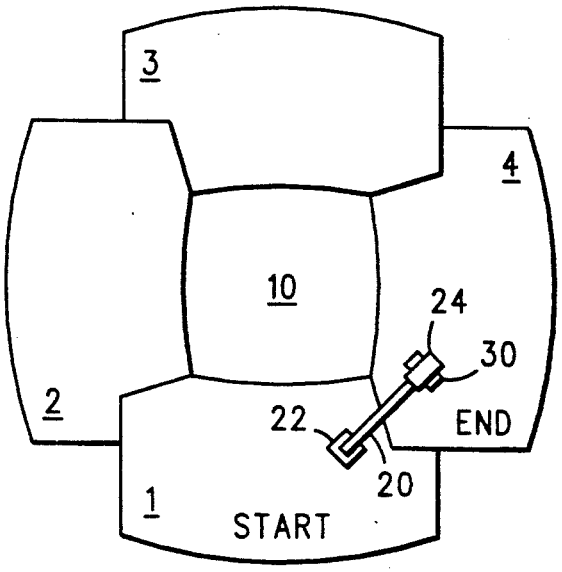
FIG.5

HEAD BRIM FOR USE DURING HAIR DRYING

BACKGROUND OF THE INVENTION

The present invention relates generally to the field of hair drying aids and, more particularly, to a means for directing hot air away from the face of a user while using a hot air blower or hair dryer.

One source of irritation suffered while one uses a hot air blower to dry their hair is that the hot air also blows down over their face and ears which can be uncomfortable. If this hot air could be deflected from the face of a person as they dry their hair or sit in an hair dryer the aforementioned source of irritation could be eliminated.

Thus a need exists for an apparatus that is convenient, sanitary, light weight, and which can be folded neatly away while allowing one to wear about their head to deflect hot air away from one's face.

SUMMARY OF THE INVENTION

Accordingly, there is provided a brim that can be placed around the head of an user whereby air directed from the top of the user's head is deflected from the user's face. The brim comprises a plurality of links forming a chain with each link being pivotally connected to adjacent links which can be adjusted and fastened about the head of the user. Each of the links has top and bottom coplanar surfaces, an outer edge having a first arc of a first predetermined radius, an inner edge having a second arc of a second predetermined radius with a center portion of the inner edge being formed perpendicular to the top surface of the link; the center inner edge portions being pivotally attached to one another by a flexible connector; and having fastener for removably fastening the first and last ones of the plurality of links together.

BRIEF DESCRIPTION OF THE DRAWING

FIG. 1 is a top view of three links of a chain of links of the apparatus of the present invention;

FIG. 2 is a side view of the apparatus of the present invention;

FIG. 3 is a top view illustrating a single link of the apparatus of FIG. 1 prior to being formed to its final shape;

FIG. 4 is a perspective view of a single link of FIG. 1; and

FIG. 5 illustrates the embodiment of the present invention in a folded away configuration.

DETAILED DESCRIPTION OF THE PREFERRED EMBODIMENT

Turning now to FIGS. 1–4, there is shown head brim or band 10 of the present invention which is worn about the forehead of a user to deflect air directed downwards from the top of the head of the user from the user's face to improve the comfort of the user. FIG. 1 shows three links 1–3 of a plurality of links of brim apparatus 10 which form a chain of approximately 12 links (not shown) depending on the size of the user's head. Typically, the length of the assembly of the plurality of links is about twenty (20) inches but can be adjusted to the desired length to fit about the user's head by removing one link at a time. Each link may be formed of approximately 0.010 inch thick flat PVC plastic and is approximately 3.5 inches long and 2 inches wide in which the top and bottom surfaces are coplanar. It is understood that any durable flexible material may be used and PVC is but one example.

As shown in FIG. 3, each link of the assembly is pre-fabricated with an outer edge 4 having a radius of curvature of approximately 6 inches and an inner edge comprising end portions 6' and 6'' and outwardly notched out center edge portion 8 centrally located between parallel ends 12 and 14; each of the inner edge portions having a radius of curvature of approximately 4 inches. During fabrication, center edge portion 8, which is approximately one-half inches wide is bent at 90 degrees to the top surface of the link as shown by the dashed lines and seen in FIG. 4 so that the top and bottom surfaces of the links form an outwardly facing flange member which will deflect air away from the user's face. The end edge portion 6' is shown at 7 as having an one-eighth diameter while end 6'' is shown as being angled at approximately 17 degrees with respect to the tangent line of center portion 8. The shape and geometry of edges 6' and 6'' provide maximum overlap of the assembled links when folded 180 degrees for compact storing of the brim and also aid in straightening the assembly out for easy cleaning.

The assembly of brim 10 starts by lining the last link of the chain to be formed by the plurality of links on a straight edge and proceeding to align all remaining links by placing the next link on top of the preceding one. Thus, link 2 is placed on top of link 3, link 1 on top of link 2, etc., with the ends 13 of center edge portions approximately 1/32 of an inch apart as shown in FIG. 2. The links may be firmly located in place during assembly by using, for example, alignment holes 16 which are placed over assembly pins (not shown); any other methods or choices may be utilized as desired to align the links with respect to each other.

As shown in FIG. 2 all of the links are laid flat upon each other with bent up center end portions 8 aligned to one another. All of the links are then connected to one another by using, for example, one-inch wide adhesive tape applied along one side of the center end portions 8 of each link in a continuous manner. Assembly is completed when the tape 18 (FIG. 4) is bent over the extending center edge portions 8 and squeezed into final contact therewith. The use of flexible tape or other connecting means allows all of the links of brim 10 to be pivotally connected to one another at ends 13 which form the pivot hinge for each link as shown by link 1 (in dashed outline form in FIG. 1) being rotated which allows brim 10 to easily conform to the shape of the head of the user during use thereof.

When assembled, brim 10 forms a flexible, two inch wide head band which can be adjusted to encircle the user's head above the eyes with edges 8 extending upwardly in contact with the head and edges 4 of the plurality of individual links extending outwardly at approximately ninety degrees from the forehead of an user thus deflecting hot air, produced within well known "basin-like" hair dryers and blowers, that hits the upward surfaces of the extended links away from and flowing over the face and lower head of the user. Brim 10 is held in place about the user's head by fastening means shown in FIG. 5 comprising a one or two inch long elastic piece 20 which is affixed at 22 to starting link 1. The other end of elastic 20 has a strip of Velcro 24 attached thereto which removably clamps to mating Velcro strip 30, the latter of which is attached to end link 4.

FIG. 5 illustrates how brim 10 can be folded up when not used and can be slipped into a six inch plastic sandwich bag, for example, for convenience in storing and carrying. Brim 10, being made of plastic can be easily cleaned as it does not absorb moisture thus solving hygienic problems. In addition, an absorbant material (not shown) may be adhesively attached to the inside of portions 8 of brim 10 to absorb perspiration and can be removed after use.

Hence, what has been described above is a novel head band brim which is easily adjustable to be placed about a user's head to deflect hot air from the face while a hot air dryer or blower is used.

What is claimed is:

1. A brim for use about the head of an user, comprising:

a plurality of links, in excess of three, each individual link having top and bottom coplanar surfaces, outer and inner edges, parallel first and second edges, said outer edge having a first predetermined radius of curvature and said inner edge having a second predetermined radius of curvature different from said first radius of curvature, said inner edge having end portions and a notched center portion with said center portion of each link formed perpendicular to said top surface thereof;

means for providing pivotal connection of each of said plurality of links to an adjacent one of said plurality of links across said center portions of said inner edges thereof with a portion of said second end of each preceding link overlapping the first end edge of the proceeding link whereby said inner edges of said plurality of links encircle the user's head with said center portion extending upwardly and said top and bottom surfaces extending outwardly from the user's head; and means for removably fastening a first and a last one of said plurality of links together to aid in holding said plurality of links about the user's head.

2. The brim of claim 1 wherein each one of said plurality of links is comprised of a flexible plastic material approximately 0.010 inches thick and said center portion of said inner edge comprises a flange portion notched outward from said end portions of said inner edge of said link prior to being formed perpendicular to said top surface.

3. The brim of claim 2 wherein said connection means comprises adhesive tape bent over and connecting said center portions of said inner edges of said plurality of links.

4. A brim for forming a headband to be worn about the head of a user, comprising:

a plurality of flexible links, in excess of three, pivotally connected together, each link having top and bottom coplanar surfaces, an outer edge and an inner edge with a center portion of said inner edge being perpendicular to said top surface thereby forming an outwardly facing flange member with respect to the user's head when the brim is worn;

means for pivotally connecting the center inner portions of each of said plurality of links together; and means for fastening a first and a last one of said plurality of links together to hold said inner edges of said plurality of links about the user's head during use with said perpendicular center portion extending upwardly and said top surface extending outwardly from the user's head when the brim is worn.

5. The brim of claim 4 wherein each of said plurality of links further comprise said outer edge having a first radius of curvature, said inner edge having a second radius of curvature, and having parallel end edges.

6. The brim of claim 5 wherein each one of said plurality of links is comprised of a flexible plastic material approximately 0.010 inches thick and said center portion of said inner edge comprises a flange portion notched outward from said end portions of said inner edge of said link prior to being formed perpendicular to said top surface.

7. The brim of claim 6 wherein said connection means comprises adhesive tape bent over and connecting said center portions of said inner edges of said plurality of links.

* * * * *